United States Patent [19]

Sivilotti et al.

[11] 4,345,743

[45] Aug. 24, 1982

[54] MEANS AND METHOD FOR CONTAINING FLOWING OR STANDING MOLTEN METAL

[75] Inventors: Olivo G. Sivilotti; John Sulzer, both of Kingston; Alan F. Treganza, Sydenham, all of Canada

[73] Assignee: Alcan Research and Development Limited, Montreal, Canada

[21] Appl. No.: 196,100

[22] Filed: Oct. 10, 1980

[51] Int. Cl.[3] ..... C21C 5/46; C22B 9/00

[52] U.S. Cl. ..... 266/44; 266/236; 75/68 R

[58] Field of Search ..... 75/61, 65 R, 68 R; 266/44, 236, 242, 270, 88; 165/177

[56] References Cited

U.S. PATENT DOCUMENTS

| | | | |
|---|---|---|---|
| 2,191,337 | 2/1940 | Clark | 75/65 R |
| 2,255,549 | 9/1941 | Kruh | 75/68 R |
| 2,678,266 | 5/1954 | Zifferer | 266/242 X |
| 2,836,412 | 5/1958 | Krieger | 266/242 X |
| 2,986,783 | 6/1961 | Shapiro | 266/236 |
| 3,110,939 | 11/1963 | Lockwood | 75/61 X X |
| 3,446,032 | 5/1969 | Bottum | 165/177 |
| 3,583,476 | 6/1971 | Woebeke | 165/177 X |
| 3,722,821 | 3/1973 | Jaeger et al. | 266/236 X |
| 4,007,036 | 2/1977 | Gottschol et al. | 75/65 R X |

FOREIGN PATENT DOCUMENTS

| | | | |
|---|---|---|---|
| 289,748 | 10/1977 | U.S.S.R. | 266/236 |

*Primary Examiner*—L. Dewayne Rutledge
*Assistant Examiner*—David Hey
*Attorney, Agent, or Firm*—Cooper, Dunham, Clark, Griffin & Moran

[57] ABSTRACT

Molten metal, such as aluminum, is held within rigid refractory lining means beneath, above and alongside the metal while heaters keep the outside of the lining means at a predetermined temperature desired for the metal, the heaters being surrounded by thermal insulation and the whole being surrounded by a fluid-cooled support. An unusually effective embodiment is pipe, with a tubular refractory liner to carry flowing metal, surrounded by sheathed heating elements controlled to keep the exterior of the tube at least at about the predetermined temperature, with the thermal insulation wrapped around the heaters and the enclosing support being a water-jacketed steel pipe. The operation is essentially adiabatic with respect to the refractory liner, delivering the molten metal essentially at its original temperature, with unusual saving of heat energy. When the heated pipeline has been drained, only easily removed, paper-thin skulls of solid metal remain.

10 Claims, 8 Drawing Figures

MEANS AND METHOD FOR CONTAINING FLOWING OR STANDING MOLTEN METAL

BACKGROUND OF THE INVENTION

This invention relates to methods and means for containing molten metal such as aluminum, whether flowing or stationary, in such fashion as to keep the metal in molten state at a desired temperature. In a more specific sense, the invention is concerned with vessels for holding molten metal, e.g. non-ferrous metal such as aluminum, which is to be kept molten at a temperature of not more than about 1350° F., in such fashion that significant economy of heat is achieved while the molten metal is effectively maintained at a selected temperature.

In a particularly important sense, the invention is related to pipeline for molten metal, notably molten aluminum, so arranged and operated that molten metal can be transported through the pipeline over relatively long distances with essentially no fall in temperature and no undue consumption of applied heat.

Heretofore, various efforts have been made to transport molten metal, i.e. molten at the temperature described above, as by troughs or pipes so that, for example, the metal may be conducted from a melting or holding furnace to a fabricating locality, such as a casting machine which is required to be supplied with such metal either intermittently or continuously. As commonly made with appropriate insulation, metal conducting troughs have often been employed, with some advantage in that they allow access for removal of so-called skulls after each use, but such troughs tend to dissipate heat so that there is considerable drop in temperature of the metal between entry and exit of the system, limiting the attainable length of travel and creating a risk of cooling the metal below a temperature appropriate for the selected casting operation.

Insulated pipes have been proposed, having a refractory lining in a strong steel shell, and while they have a further advantage in reducing the exposure of the molten metal to air, thus avoiding unwanted oxidation, they have nevertheless been characterized by difficulties similar to those of open troughs. Moreover, in all of these cases, there is some problem in starting up the system, in that the first flow of metal must lose some heat in order to raise the temperature of the trough or pipe, with special risk of casting machine difficulty at this particular time.

Some efforts have been made to design troughs with refractories of very high insulating property and also by adding covers which might include heating devices. It has nevertheless remained difficult to avoid temperature drops along the system and to control the operation so as to avoid overheating the metal, or waste of heat, or fall of metal temperature too close to the melting point. The energy loss in many heated lines is a necessary penalty of the system, and it adds to the operating cost. Indeed, under the best of previous circumstances, trough lengths have not usually exceeded about 10 meters, or perhaps with high metal flow rate, as much as a total of 20 meters.

In one form of previous system utilizing refractory, insulated troughs or launders to carry the metal from a central locality to equipment utilizing it, efforts have been made to keep them substantially horizontal so as to have the least air contact of the metal surface by turbulence, and at the same time electric heaters have been disposed over the passing metal, or the metal is held and heated in a local furnace, with the object of keeping the metal molten while trying to minimize oxidation.

In another system, the transfer is through holding pans, comprising an open pan-like shell of steel, lined with a thick layer of insulation. The outside of the steel shell has cooling pipes, chilled by passage of fluid coolant. This arrangement is said to avoid cracking or damage to the refractory lining when the system is heated up by the molten metal or cooled down when the metal is drained; yet it neither saves heat nor insures economical maintenance of desired metal temperature.

In most of these prior devices, there remains the problem of loss of heat as the molten metal progresses along the system, with corresponding limitation, as explained above, on the distances to which the metal can be transferred. At the same time, in such covered trough arrangements as had included some heat supply (as in the trough covers), operation has not been very economical and control of temperature may not be satisfactory; there may even be variations affecting the metallurgical uniformity of products cast from the metal.

SUMMARY OF THE INVENTION

For desired improvement in containing molten metal, particularly metals having melting points not appreciably higher than about 1400° F., and in a very special sense, molten metal such as aluminum, to be kept at a temperature below 1350° F., the present invention contemplates dispensing molten metal in a structurally rigid, refractory shell or tube, which around its outer surface is subjected to the application of heat in a controlled manner. Around the exterior of the heating means, thermal insulation is maintained, and the entire assembly is supported by suitable structure such as a heavy steel pipe enclosing the refractory tube, heating means and insulation. The exterior of such structure, e.g. the steel pipe, can be positively cooled, as by attached tubes or a jacket, through which water or equivalent coolant is passed.

A particular feature of the assembly and method is that the heat supply, e.g. furnished by electrical heating rods of known type, is controlled so that there is essentially no actual flow of heat through the refractory shell (when it is holding the metal) in either direction. In this fashion, the temperature of the contained metal is kept at a selected value, i.e. approximately the value it had as delivered to the pipe. The effect of the refractory tube and surrounding heater, together with economy of operation as afforded by the outer insulation and the supporting, cooled structure, is such that the pipe can be characterized as adiabatic, in the sense that this is a system or process in which there is preferably no flow or loss of heat inward or outward, e.g. between the molten metal and the outer surface of the refractory shell. That is to say, the heating means keeps heat from flowing outward from the molten metal, nor need there ordinarily be any heat flowing into the molten metal from the pipe structure. In the preferred and most economical operation, the heat tending to emanate from the metal and the heat radiating inward from the heating elements, are no more than needed for balance and avoidance of heat loss. There is advantageously no heat transferred from the internal part of the pipe, and the only heat utilized in significant effect is that which is necessary to keep the outer surface of the refractory tube at constant temperature, with minor, unavoidable loss through the outer insulation and by absorption in the circulating coolant.

The invention is primarily applicable to conveying molten metal in a closed pipeline, which is arranged and operated as above described. The invention is also adaptable to vessels where the metal is more or less stationary, such as holding pans or troughs, at terminal or intermediate localities of a distribution system. In a situation where the vessels are not characterized as pipes for conducting molten metal, it will be understood that the invention requires an essentially complete enclosure (e.g. including a cover or lid) which is entirely made and operated in accordance with the above underlying principles. That is to say, in each instance there is a holding shell or structure of rigid refractory, within which the molten metal is contained. Around this refractory shell, i.e. at its sides and beneath its bottom and over its top, there is a heating means, in effect covering the whole of the refractory shell, surrounded by insulating material and contained within a suitably cooled or chilled outer structure, e.g. such as a steel pipe or equivalent steel container.

In all cases, the preferred method is that the outer surface of the inner refractory shell, tube or vessel be maintained at a constant temperature, and indeed the same temperature as is desired for the molten metal itself. In this fashion, the system or process can be truly described as adiabatic, with the economy and efficiency described above. The prime result is that the metal is maintained in a molten state, at the temperature desired, with essentially no temperature loss or change as to interfere with the desired casting operations.

As may be understood, the system has the advantage that it can be very easily preheated to the exact desired temperature so that no heat is lost from molten metal during the start-up interval. Another great advantage is that if the system is closed down and needs to be drained, the heating means can be continued at the same controlled point, whereupon it will be found that after draining the molten metal, there is almost no skull remaining. Only a very thin skull covers the interior surface of the pipe, such that it can be readily scraped or brushed out after solidification.

In a specific form where the invention is constituted as pipe to be filled with flowing molten aluminum such as any one of various common aluminum alloys, it is convenient to keep the molten metal at about 1300° F. Under such circumstances of preferred use of the pipeline, the heater is operated, while controlled, e.g. by a junction thermocouple at the outside of the refractory tube, so as to reach and keep a temperature of 1300° F. at this point. Preheating in such manner is ordinarily sufficient within 2 to 4 hours, and the temperature of 1300° F. is readily maintained thereafter, i.e. when and as molten aluminum fills and flows through the pipe. During this operation, the heater is continually operated so as to maintain the exterior surface of the refractory tube at 1300° F.

When the feed of molten metal is to be discontinued, the heaters in the pipe are nevertheless kept energized, to maintain the outside of the refractory tube at the same 1300° F. When the bulk of the metal has been drained, the pipeline can be separated at the remote or delivery locality and can be tilted up to complete drainage back to the source. Only then are the heaters of the pipeline turned off; after cooling, only a minimum of paper-thin metal skulls remains.

Further details and characteristics of the invention, as to apparatus and methods, are described below, particularly in connection with the accompanying drawings which illustrate a presently preferred example of a pipe section and the use of such sections in a line of pipe.

DETAILED DESCRIPTION

Figure 1:
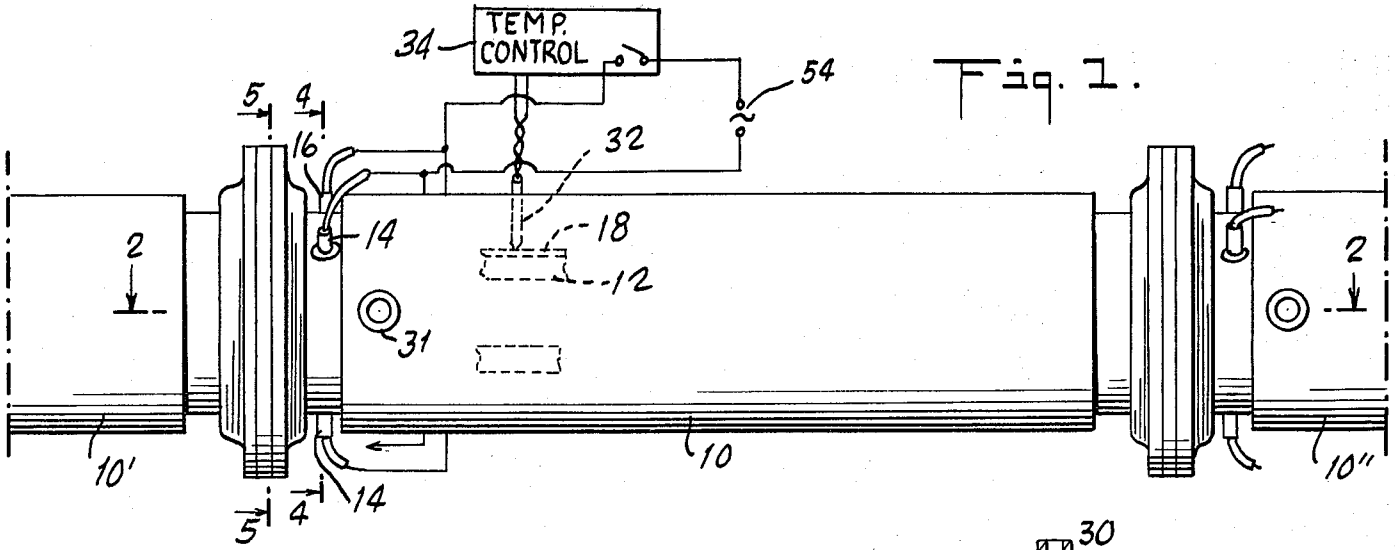
FIG. 1 is an elevational view showing a pipe section embodying the invention, as endwise connected in a pipeline embodying other, like pipe sections in succession.

Referring to the drawings, particularly FIGS. 1-6 inclusive, the invention is illustrated in a specific and unusually advantageous form, i.e. a pipe for transfer of molten metal such as aluminum. The pipe is embodied as separate sections 10, 10', 10'' which are connected endwise to form a line of pipe through which molten metal can be advanced. Basically, each pipe section comprises an inside tube 12 of refractory composition, having sufficient strength to serve as the actual metal enclosure, e.g. enclosing a cylindrical space through which the molten metal can travel, very preferably filling it. Advantageously, the refractory tube 12 is made of a fibrous refractory, such as can be produced as a matted or felted aggregate of ceramic fibers, one example being the fibrous ceramic refractory known as Fiberfrax. These mineral refractory tubes are preferably coated or partly impregnated with a hardening and anti-wetting compound, i.e. to inhibit damage by the molten metal and/or entry of the molten metal into the pores of the material. Such treatment may involve a mineral or other inorganic cement, applied in a liquid medium or state and allowed to dry or harden in place.

Around the refractory tube or liner 12, there are disposed heating elements 14,16, which are contemplated to be of the rigid rod type, and can be preformed into a desired shape. As will be seen, there may be two such elements (14,16) for each cylindrical length of pipe, shaped to run lengthwise along the tube 12, first in one direction and then turning and coming back from the opposite end, in the other direction, and so on, whereby a cage-like structure is attained and in effect supplies heat to the entire outer surface of the tubular refractory 12. Preferably, the heating elements are protected by a suitable sheath on each side, i.e. an interior and exterior cylindrical structure of sheet metal, advantageously stainless steel, such as S.S. No. 304, a well known chromium-nickel stainless steel composition. These cylindrical sheaths 18,20, thus protect the heating rod structure, and act as thermal diffusers from the electrical elements to the refractory liners.

Around the heating means, there is a layer of thermal insulation, which can also be refractory in its basic properties, designated 22. This insulation 22 may consist of a thick felted layer of mineral, fibrous refractory or similar material, i.e. silica or like composition, which is wrapped around the outer cylinder 20 of stainless steel sheet. The assembly consisting of the inner refractory tube 12, the cage structure of heater rods 14,16 with their protective sheets, and the surrounding layer of heat insulation 22 is then pushed into a relatively heavy steel pipe section 24, to produce a complete heated and insulated assembly. The steel pipe section may have end flanges 25,26 which can be bolted (see FIGS. 5 and 6) as at 27, in order to fasten the pipe sections together in end-to-end relation.

To hold the interior structure in place and assure best alignment of such structure between successive pipe sections, an annular plug 28 is provided at each end of the assembly; the plug has two ring shaped, parallel faces, of which the smaller one is adapted to abut the end of the thermal insulation 22 and heater assembly 14–20, and the wider is arranged to adjoin the corresponding face of the like plug or cap of the next pipe section. As will be noted, these annular plugs thus have a tapered configuration, inwardly of the end of the pipe, so as to fit into properly shaped seats between end flange 25 or 26 of the supporting steel pipe 24 and a suitably machined zone around the outside of refractory tube 12.

The steel pipe 24, which serves as a main supporting structure for its pipe section, is surrounded with a cooling jacket, or other suitable cooling means, indicated at 29, and shown with water inlet and outlet passages 30,31. Thus cooling fluid, i.e. water, can be circulated in the jacket 29 around the outside of the assembly, e.g. to keep the steel pipe 24 essentially at ambient or atmospheric temperature, or not far above such point.

For temperature control, a suitable heat-sensing element, such as a junction thermocouple 32, may be arranged inside the assembly with its sensing means engaging the outer surface of the refractory liner 12, or the stainless steel sheet 18 immediately next to the latter. As will be seen from FIG. 1, the heating elements, which may be of the so-called Calrod type, are connected in parallel, and together in series with a temperature control instrumentality 34, shown as respectively closing and opening the circuit of the heaters when temperature increase or no delivery of heat are respectively called for by the sensing element 32.

Thus, for example, if the pipeline is filled with a conventional aluminum alloy having a melting point in the region of 1220° F., and it is desired to keep the actual temperature of the flowing alloy that fills the pipe at about 1300° F., the temperature control 34 is set to maintain this value at the thermocouple 32, i.e. on the outside of the tubular liner 12. As will be understood, the heater elements 14,16 will cycle between on and off conditions, as necessary to maintain the selected temperature at the outside of the refractory liner.

Figure 5:
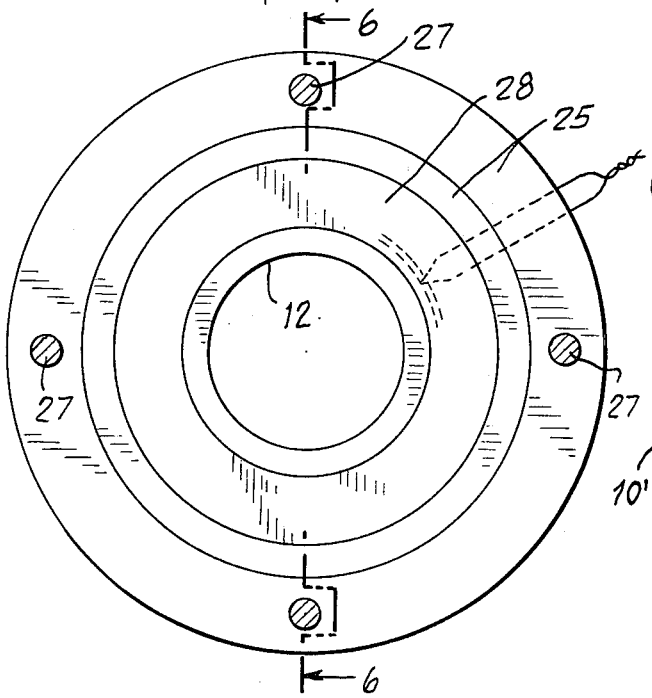
FIG. 5 is an enlarged view, being a section on line 5—5 of FIG. 1.
Figure 6:
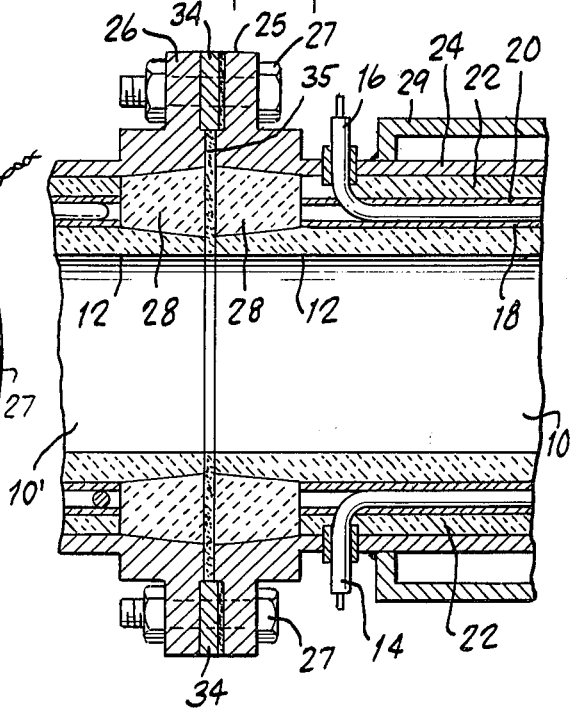
FIG. 6 is a section on line 6—6 of FIG. 5, fragmentary in showing one end of each of two joined pipe sections.

FIGS. 5 and 6 also show details described in connection with FIGS. 1 to 4, plus certain details that may be embodied at the actual junction between successive pipe sections. As shown, each length of steel pipe 24 has integral end flanges 25,26, at its respective opposite ends, being conventional pipe flanges provided with holes through which bolts may be passed and fastened as shown at 27.

The flanges 25,26 may be so arranged that a spacing ring 34 is clamped between them, thereby avoiding excessive pressure on a gasket 35 that is compressed between certain facing areas of the flanges 25,26 and the enclosed structure at the ends of the pipe sections, i.e. including the annular plugs 28 and the ends of the liners 12. As will be appreciated, the gaskets 35 can be of suitable fibrous refractory, such as layers of Fiberfrax paper.

Figure 8:
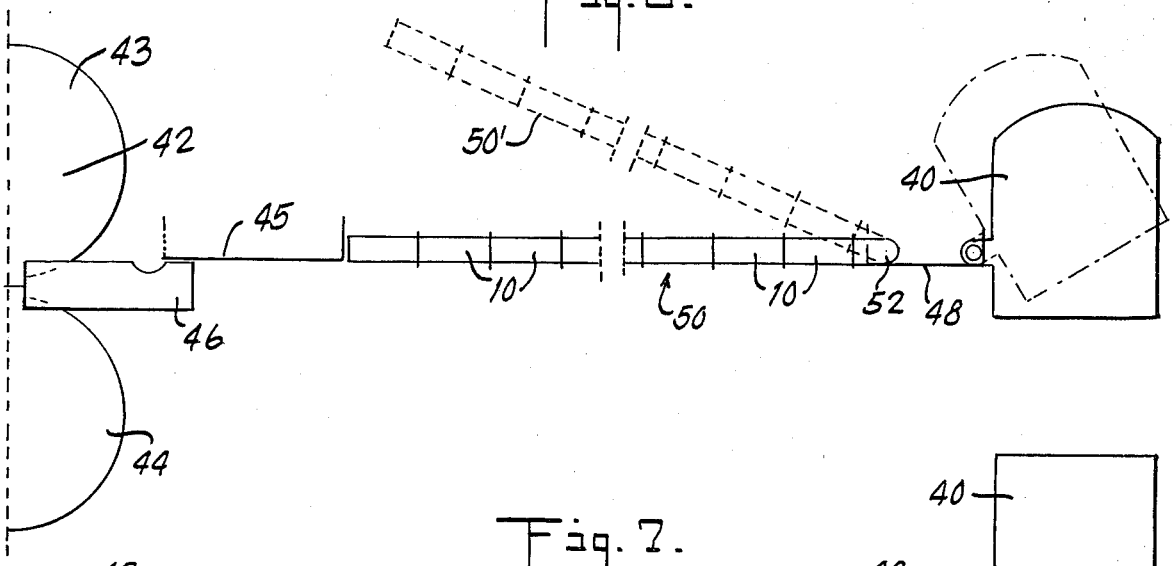
FIG. 8 is an elevational, diagrammatic view of the schematic arrangement in FIG. 7, illustrating the tilting of the furnace and also the tilting of the pipeline to drain it when desired.
Figure 7:
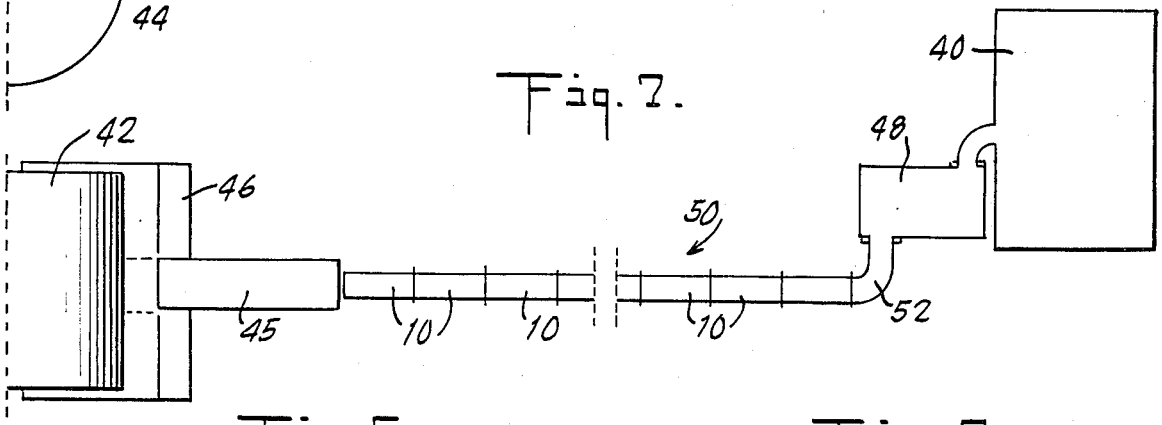
FIG. 7 is a diagrammatic plan view, showing a schematic view of pipeline of the invention arranged to transfer molten metal from a receiving pan of a furnace, to a continuous casting machine such as a twin belt caster.

A schematic view of the pipe in use is given in FIGS. 7 and 8, it being understood that the elements of the system are by no means there shown to scale, as for instance in that the furnace shown would be much larger and the length of the pipeline can be much longer, relative to the casting machine as here depicted.

As will be seen, a tilting furnace 40 where the desired metal such as aluminum is established in molten state, is intended to provide molten metal supply for casting equipment 42, for example of the twin belt type having belts 43 and 44 between which molten metal is to be supplied from a pan or tundish 46 which receives the metal from a launder 45. The furnace 40 is at appropriate times tilted or tipped so that molten metal flows into a supply trough or vessel 48.

Between the vessel 48 and the launder 45, pipeline 50 is arranged with successive pipe sections 10 as of the sort described above, conveniently connected to the vessel 48 with an elbow section 52, which is preferably of similar, heated type and which is pivoted so that when the pipeline 50 is disconnected from the vessel 45, it can be swung up to the position 50′ (FIG. 8) to drain the molten metal back into the dish 48.

As will be understood, the preferred practice of the invention, as for supplying molten metal from a furnace 40 to a casting machine 42, is first to energize the heating elements in each of the pipe units 10 (or other corresponding vessels) wherein the desired temperature (above the metal melting point) is to be maintained by control at the outside of a refractory tube or the like. Conveniently, heat is thus supplied, with the thermostat control aimed at the desired temperature, e.g. 1300° F. for most aluminum alloys, this being a preliminary step to the filling of the pipe with molten aluminum.

When the temperature of the inner surface of the tubular liner, as well as the element 32, reaches the desired value after the preliminary operation of one-half to one hour, and assuming that all structures are in place as seen in solid lines in FIGS. 7 and 8, the furnace is then tilted up so as to fill the supply vessel 48 and so that molten metal can start flowing from the latter through the pipe to the vessels 45 and 46 for operation of the caster. It is found that the pipeline 50 can essentially handle any rate of flow of metal as the metal head may dictate, and during the entire time of flow, the thermostat control of the heaters effectively maintains the selected temperature at the outer surface of the liner 12 through which the metal passes.

During this entire time, of course, the coolant water flow is established and continued through the outer jacket 29 of each pipe section, so that with the aid of the insulating layers 22, the steel pipe structures 24 are in effect held at temperatures well below that of the molten metal or of the tubular liner 12. The insulation 22, of course, also prevents any large losses of heat from the heater elements 14 and 16. Throughout the whole of a run of operation of the casting apparatus, molten metal may flow along the pipeline 50. If during any such interval the flow has to be interrupted, maintenance of heated condition of the pipeline, with the described heaters and of course with the continued exterior cooling, keeps conditions as desired so that there is no freeze-up of metal, nor is there any excessive temperature reached.

When the operation is completed and it is desired to discontinue metal feed for some time, the flow is first interrupted and then the entire pipeline is suitably displaced so as to drain the molten metal, for example by being lifted to the sloping position 50' in FIG. 8. During this time, of course, the heater elements are continued in operation. As a result, the metal flows back to the trough or pan 48, and indeed even into the furnace if the arrangement so permits, and in all instances, there is effective draining of the pipeline 50, except for a very thin layer or residue. This residue of molten metal, when the electric current is now discontinued to the heaters, solidifies as an extremely thin or fragile skull, indeed paper-thin, which can be brushed or shaken or even blown out of the pipe sections, with no damage to the refractory liners as might easily occur with heavy skulls. That is to say, in ordinary handling of molten metal, rather heavy skulls are found in the equipment, which must be broken out with correspondingly heavy steel implements which frequently damage any refractory surfaces of usual type.

It will be noted that the pipe sections are separated and removed with relative ease, by virtue of their simple bolted flanges 25,26, so that there is essentially no trouble involved in cleaning the paper-thin skulls of metal that may remain, or in achieving another service that the pipe sections may require.

Figure 2:
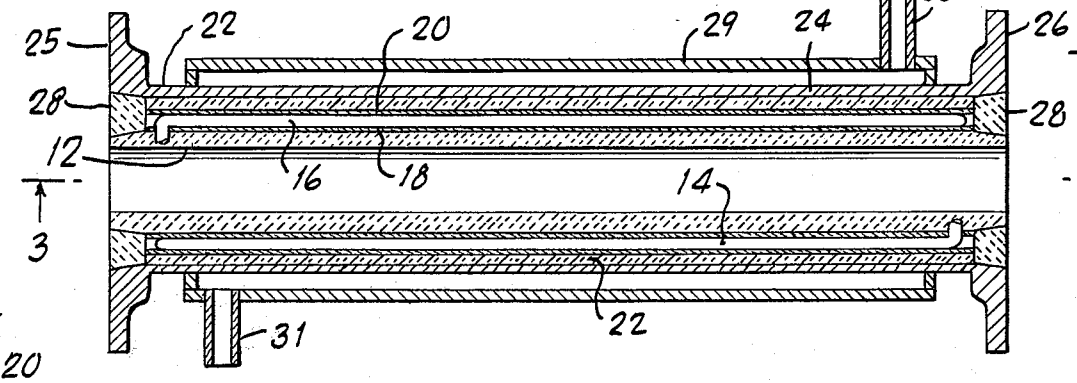
FIG. 2 is a horizontal section, on line 2—2 of FIG. 1, of a principal pipe section, as a unit, of the last-mentioned figure.
Figure 3:
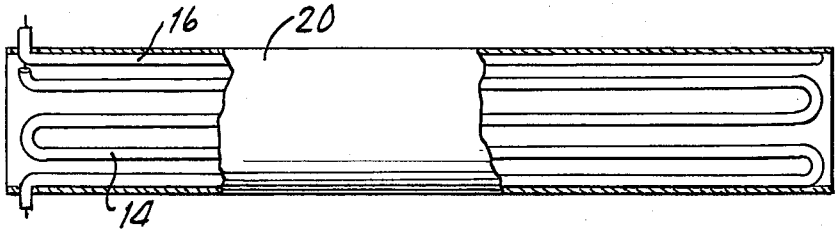
FIG. 3 is a partially elevational and partially sectional (vertical) view, as if on line 3—3 of FIG. 2, showing certain interior structure of a pipe section, notably the electrical heating elements, this view also being represented as a section on line 3—3 of FIG. 4.
Figure 4:
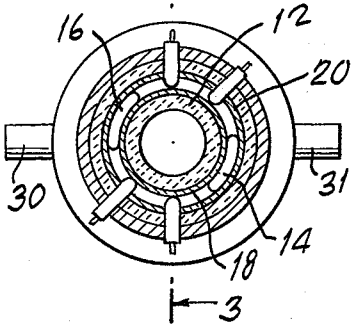
FIG. 4 is a section on line 4—4 of FIG. 1.

By way of example of the structure of pipe sections found satisfactory for conveying molten aluminum, e.g. at a temperature of 1300° F. or so, the following materials and dimensions were used. The Fiberfrax tube 12 for each section of pipe was 4 feet long, with inside and outside diameters of 5 inches and 7 inches, respectively. The sheathing around the electrical heating elements 14 and 16 consisted of spaced cylinders of 304 S.S. sheet 0.028 inch thick, which was satisfactory for the protective and supporting function. Around the heating elements there was a layer of insulation 22, also 1 inch thick, constituted by fibrous, refractory mats, e.g. of a silica-type material, such as Microtherm made by Micropore Insulation Ltd. The steel pipe section 24 which encases and supports the entire assembly is constituted by standard 10-inch pipe having a ¼ inch wall. A cooling jacket 29 is conveniently provided by a length of 12 inch I.D. pipe terminated by interior spacing rings which are mounted, as by welding, on the outside of the supporting pipe 24, e.g. as shown in FIGS. 1, 2 and 6.

The described structure served effectively in extensive testing and was found to require little servicing or replacement of materials or parts, over relatively long periods of time. As will be understood, each pipe length is provided with temperature control for the contained electrical heater elements, e.g. as shown in FIG. 1 and including the thermocouple 32 sensing continuously the temperature at the outer surface of the refractory liner 12. Electrical heating units 14,16 were of the Calrod type, e.g. a structure designated Chromalox, each utilizing 2,000 watts and connected (through the control 34) across the 240-V line 54.

In a further example of the method, a pipeline about 120 feet long was installed experimentally in an aluminum fabricating plant in Canada, to supply molten aluminum to a twin-belt casting machine, i.e. equipment designed to receive molten metal and to deliver cast aluminum strip. This pipeline required 30 four-foot lengths, embodied as described above, and arranged to carry molten metal from a receiving vessel at the furnace, to the tundish of the caster, in the manner schematically shown in FIGS. 7 and 8.

In one extended test, on an industrial scale, the pipeline was in operation to carry molten aluminum at 1300° F. and at rates up to 1,000 pounds per minute, i.e. through the 5 inch diameter pipe. The temperature drop through the entire distribution line was on the order of 10° F., and could indeed be even less in a repeated test, since in this instance the end sections and elbows of the pipeline were made without heater assemblies. In each instance, of use for a casting operation, the line was heated up before molten metal started to flow and was kept heated at the end while molten metal was drained back and out. Only paper-thin skulls were found in each case when the pipeline had been drained and cooled, and these were very easy to clean so that practically no damage to the refractory occurred. The operation was quite satisfactory and abundantly served the desired purpose of supplying the molten metal at the desired temperature, with a minimum of difficulty and with obvious economy of heat.

Since the pipe sections have a high level of thermal insulation, and as distinguished from troughs, have a minimum of circumferential area for the cross-section area, there is a minimum of heat loss, and high efficiency in saving heat energy. There is some latitude, either way, in control of the heaters to maintain suitable temperature for the molten metal; for example, the outside of the tubular liner can be kept at a somewhat higher temperature than the received metal, as at certain times or over certain parts of the line, or even as needed if the system is used to raise the metal temperature slightly. Ordinarily, it is sufficient to reach and keep the exterior of the liner at the desired metal temperature (e.g. 1300° F. for aluminum alloys), providing a truly adiabatic pipeline, and affording adequate preheating of the liner interior (about 2 hours) to the metal temperature and adequate maintenance of temperature while the metal is drained at the end of a run. It was found, moreover, that water at ordinary temperature (e.g. 68°–77° F.) could readily be circulated in the jacket 29 so that the thermal expansion and contraction of the steel pipe 24 was approximately the same as the refractory tube 12, thereby avoiding any tendency of undue stress on the latter.

It is to be understood that the invention is not limited to the specific structures and procedures herein shown and described, but may be carried out in other ways without departing from its spirit.

We claim:

1. A method of containing molten metal, comprising:

a. disposing the molten metal, at a predetermined temperature value, in a predetermined space while b. maintaining refractory lining material beneath, above and alongside the metal, in defining relation to said space, to surround the molten metal, and while c. supplying heat to substantially all exterior surfaces of said lining material, and d. controlling said supply of heat to maintain the temperature of said exterior surfaces at least at about said predetermined value; the aforesaid method being one in which:

e. at a later time molten metal is drained from said space, to empty the space, and in which f. during said later drainage of metal from the space, said supply of heat to the exterior surfaces of the lining material is maintained to keep said exterior surfaces at said predetermined temperature value until said metal has substantially all been drained away, whereby metal thereafter remaining and solidifying on the refractory lining material is at most a paper-thin layer.

2. A method as defined in claim 1, in which:

g. said refractory lining material is arranged and maintained in tubular shape to constitute said space as a pipe, and in which h. said disposition of molten metal into said space is effected by causing the molten metal to flow into and through said pipe, thereby filling it.

3. A method as defined in claim 2, in which i. the molten metal is aluminum, and j. the material in tubular shape is rigid, fibrous refractory.

4. A method as defined in claim 1, in which:

g. the heat is supplied by heating means surrounding the lining material, and which includes h. maintaining supporting structure in enclosing spaced relation to the heating means and lining material while i. inhibiting heat transfer from the heating means to said structure by maintaining thermal insulation in said last-mentioned space between the heating means and the structure, and j. circulating coolant fluid along the outside of said structure.

5. A method as defined in claim 1 which includes:

g. prior to the step of disposing the molten metal in said space, the step of directing said heat into and through said lining material to establish the temperature of the interior surfaces of said material at said value, and h. thereafter transferring the molten metal into the space while continuing said supply of heat to said exterior surfaces, i. said continued supply of heat being effective to maintain the molten metal temperature at least at about said value and thereby to impede flow of heat outward and through the lining material.

6. A method as defined in claim 1, in which:

g. the molten metal is aluminum, said temperature value being about 1300° F. and h. the said supply of heat is controlled to keep said exterior surfaces at about 1300° F.

7. A pipe for transfer of molten aluminum at a predetermined temperature, comprising a. a tube of rigid, fibrous refractory for conveying said molten aluminum, b. heating means consisting of radially spaced, concentric, heat-resistant, cylindrical shells and electrical heating elements disposed between said shells, said heating means surrounding said tube for keeping the outer surface of the tube at least at about said temperature, c. a cylindrical layer of thermal insulation surrounding said heating means, and d. a tubular structure surrounding said insulation layer, for supporting said tube, heating means and insulation means.

8. A pipe as defined in claim 7, in which:

e. the last-mentioned structure is surrounded by means for conducting fluid coolant in heat removing relation to said structure.

9. A pipe as defined in claim 7, in which:

e. the last-mentioned structure is a steel pipe and is surrounded by means for conducting liquid coolant in heat removing relation to the outer surface of said steel pipe to cool the steel pipe sufficiently to keep its thermal expansion and contraction approximately equal to the thermal expansion and contraction of said refractory tube under influence of the heating means.

10. A pipe as defined in claim 8 or 9 which includes:

f. temperature-detecting means disposed to sense temperature at a locality adjacent to the innermost cylindrical shell and the outer surface of the refractory tube, and g. means responsive to said detecting means for controlling the heating means to maintain said outer tube surface at least at about said predetermined temperature.

* * * * *